US008240815B2

(12) United States Patent
Uyama et al.

(10) Patent No.: US 8,240,815 B2
(45) Date of Patent: Aug. 14, 2012

(54) RECORDING ELEMENT SUBSTRATE, AND INKJET HEAD AND ITS PRODUCTION METHOD

(75) Inventors: Masaya Uyama, Kawasaki (JP); Souta Takeuchi, Yokohama (JP); Hirokazu Komuro, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 253 days.

(21) Appl. No.: 12/841,937

(22) Filed: Jul. 22, 2010

(65) Prior Publication Data

US 2011/0018934 A1 Jan. 27, 2011

(30) Foreign Application Priority Data

Jul. 27, 2009 (JP) ..... 2009-174178

(51) Int. Cl.
*B41J 2/14* (2006.01)

(52) U.S. Cl. ..... 347/47; 216/27

(58) Field of Classification Search ..... 347/40, 347/43, 47; 216/27
See application file for complete search history.

(56) References Cited

U.S. PATENT DOCUMENTS 6,123,410 A 9/2000 Beerling

FOREIGN PATENT DOCUMENTS

JP 11-192705 7/1999

*Primary Examiner* — Lamson Nguyen
(74) *Attorney, Agent, or Firm* — Canon USA Inc IP Division

(57) ABSTRACT

An inkjet head includes a recording element substrate for discharging ink, a supply port penetrating the recording element substrate and serving as an ink flow path, a protrusion formed at a position surrounding the supply port, projecting from one surface of the recording element substrate, and having a first metal layer at a distal end, and a supporting member having a second metal layer welded with the first metal layer and supporting the recording element substrate.

9 Claims, 8 Drawing Sheets

RECORDING ELEMENT SUBSTRATE, AND INKJET HEAD AND ITS PRODUCTION METHOD

BACKGROUND OF THE INVENTION

1. Field of the Invention

The present invention relates to a recording element substrate, an inkjet head, and a production method of the inkjet head. More particularly, the present invention relates to the ink jet head for holding and fixing a recording element substrate to a supporting member, and a production method of the ink jet head.

2. Description of the Related Art

An inkjet recording apparatus discharges ink in a minute droplet state from a plurality of discharge ports arrayed on an inkjet head, and records an image.

Generally, as a recording element substrate provided in a inkjet head, a silicon single crystal substrate having a clipping orientation of <100> (hereinafter refereed to as a silicon substrate) is used, and the silicon substrate is provided with a discharge pressure generating element for discharging ink. Further, to supply ink to the discharge pressure generating element, a supply port is provided, which penetrates the silicon substrate, and an ink flow path is formed from the supply port to the discharge pressure generating element. The ink, by pressure applied from the discharge pressure generating element, flies from the discharge port provided in the ink flow path, impacts on a recording surface such as a printing paper, and a desired image is obtained.

A through hole corresponding to the supply port of the recording element substrate is provided in the supporting member for holding and fixing the recording element substrate, and forms an ink flow path. A protrusion is provided on a second surface of the recording element substrate which is opposite to a first surface provided with the discharge pressure generating element. A leading edge of the protrusion and the supporting member are bonded by using an adhesive.

FIG. 7 is a perspective view illustrating a partially broken recording element substrate 1, which discharges multi-color inks, e.g., cyan, magenta, and yellow. FIG. 8 is a cross-sectional view illustrating one example state in which the recording element substrate 1 is fixed on a supporting member 13.

In FIG. 7, supply ports 10 are formed on a silicon substrate 2 corresponding to each color, along discharge port arrays 18 with discharge ports 12 arranged in parallel. As illustrated in FIG. 8, through holes 16 are also formed in the supporting member 13 corresponding to the supply ports 10. In a conventional structure of the recording element substrate, an adhesive for bonding the silicon substrate 2 and the supporting member 13 is used to seal a contact part of the supply port 10 and the through hole 16.

In recent years, customers have demanded an inkjet recording apparatus which shows high image quality, high brilliance, and high throughput with a low price. One method for lowering the cost of the inkjet recording apparatus is to lower a production cost of the inkjet head.

One method for lowering the cost is to increase the number of a silicon substrate taken from one silicon wafer. More specifically, an interval between the supply ports is narrowed to reduce the size of the silicon substrate, so that the number of the silicon substrate taken from one silicon wafer is increased.

However, as illustrated in FIG. 8, when the interval between the supply ports is narrowed, a bonding surface between the silicon substrate 2 and the supporting member 13 becomes small, so that it becomes difficult to coat an adhesive on the bonding surface. Further, since the bonding surface does not have a sufficient area, it becomes difficult to maintain sealing reliability of the adhesive. When the sealing reliability lowers, ink leakage from the bonding surface occurs, an amount of ink discharging from the discharge ports becomes irregular, so that a recording quality may degrade. In an inkjet head discharging multi-color inks, different color inks may be mixed, so that an image quality and definition may degrade.

To solve these problems, Japanese Patent Application Laid-Open No. 11-192705 discusses a sealing method other than use of an adhesive to increase adhesive strength between the recording element substrate and the supporting member. According to the method discussed in Japanese Patent Application Laid-Open No. 11-192705, a solder bump is used to weld the recording element substrate with the supporting member and form a fluid partition wall which partitions ink flow paths of different colors. However, since the solder bump is generally formed with a pattern of several-hundred microns, the size of the solder bump causes a trouble when the boding surface of the recording element substrate and the supporting member is to be narrowed.

As a method for sealing other than the method using an adhesive or a solder, a bump can be formed in a fine pattern and the recording element substrate is welded with the supporting member. As a general technique for forming the bump, there is a metal plating method as represented by a formation of a gold bump. However, to bond the supporting member and the bump formed on the recording element substrate by the metal plating method, it is necessary to secure a flatness of the bonding surface or to form a bump which has an enough height so that the flatness is negligible.

Particularly, when the supply port and the protrusion are formed on the silicon substrate, laser processing is used. However, in such a case, chipping and burrs are generated so that flatness is lowered. Generally, planarization processing such as chemical mechanical polishing (CMP) is indispensable for increasing flatness of a bonding surface. Further, the plating needs to be performed for a long time to form a high bump. Both of the planarization processing and the forming of the high bump increase production cost in acquiring a desired configuration.

SUMMARY OF THE INVENTION

The present invention is directed to an inkjet head capable of making a bonding surface between a recording element substrate and a supporting member finer than a conventional technique without reducing sealing reliability, and a production method thereof.

According to an aspect of the present invention, an inkjet head includes a recording element substrate, a supply port, protrusion, and a supporting member. The recording element substrate is configured to discharge ink and the supply port penetrates the recording element substrate and serves as an ink flow path. The protrusion is provided at a position surrounding the supply port, projects from one surface of the recording element substrate, and includes a first metal layer. The supporting member includes a second metal layer welded with the first metal layer and supports the recording element substrate.

According to the present invention, a bonding surface of a recording element substrate and a supporting member can be more miniaturized than a conventional technique without reducing sealing reliability. Further, the inkjet head can be produced with a lower cost.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
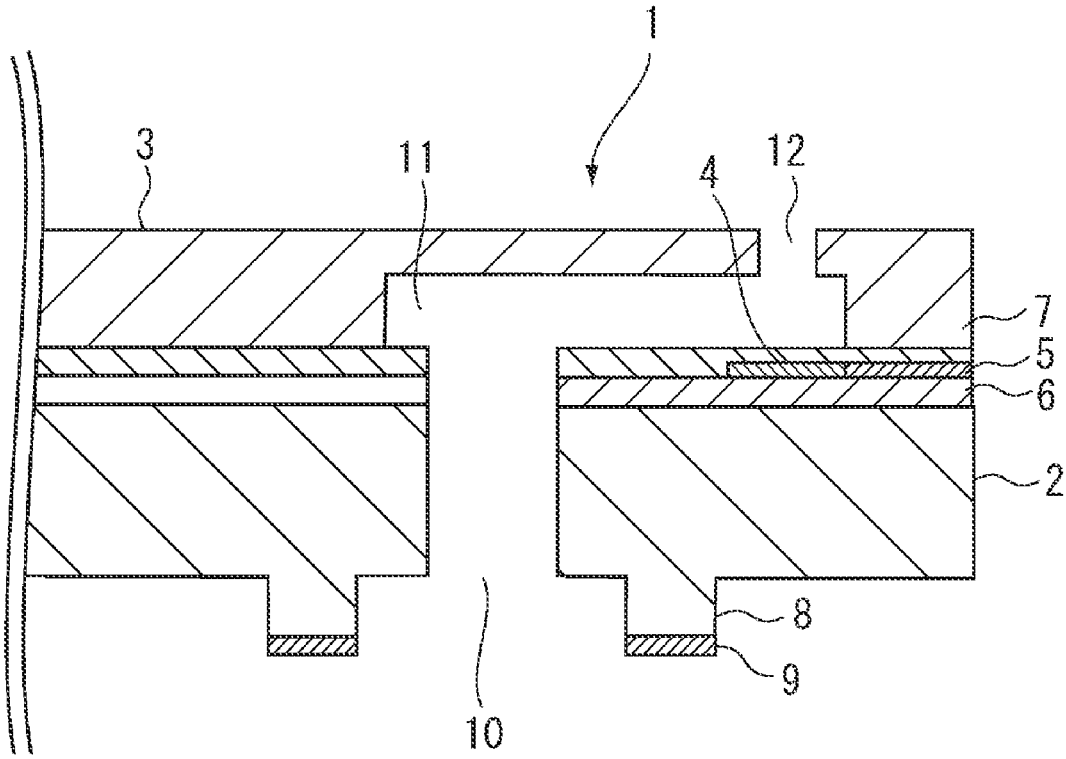
FIG. 1 illustrates a representative cross section of a recording element substrate according to a first exemplary embodiment of the present invention.

FIG. 1 illustrates a representative cross section of a recording element substrate 1 according to a first exemplary embodiment of the present invention. As illustrated in FIG. 1, the recording element substrate 1 includes a silicon substrate 2, and a flow path forming member 3 for forming an ink flow path. A thermally-oxidized film 6 for improving corrosion-resistance is formed on a surface of the silicon substrate 2 which is provided with the flow path forming member 3. A discharge pressure generating element 4 for applying discharge pressure to ink is provided on the thermally-oxidized film 6. Further, a drive circuit 5 for driving the discharge pressure generating element 4 is similarly provided on the thermally-oxidized film 6. The drive circuit 5 and the discharge pressure generating element 4 are electrically connected by an electric wiring.

Furthermore, a passivation film 7 is formed on the thermally-oxidized film 6 to insulate the discharge pressure generating element 4 and the drive circuit 5 from ink. The discharge pressure generating element 4 and the drive circuit 5 are embedded in the passivation film 7. A space formed by the flow path forming member 3 and the passivation film 7 becomes an ink flow path 11. A discharge port 12 is provided at a position opposing the discharge pressure generating element 4 of the flow path forming member 3. Ink, under pressure applied by the discharge pressure generating element 4, discharges from the discharge port 12.

In the silicon substrate 2, a supply port 10 for supplying ink to the ink flow path 11 is provided which penetrates the silicon substrate 2. A protrusion 8 is formed on a second surface of the silicon substrate 2 which is positioned opposing a first surface provided with the discharge pressure generating element 4. The protrusion 8 is made of the same material as the silicon substrate 2, and continuously formed so as to surround the supply port 10. A metal layer 9 for welding and fixing the silicon substrate 2 is provided at a distal end of the protrusion 8. The protrusion 8 and the metal layer 9 can be formed by general photolithographic etching, and thus can be formed with a 5 to 50 μm pitch.

The protrusion 8 and the metal layer 9 can be accurately formed and arranged by performing photolithography/etching, and can be formed near the supply port 10.

A material for the first metal layer 9 can be selected from inactive metals which are not eluted in ink, or from alloys including metals which are not eluted in ink. For example, gold or platinum can be used. A thickness of the first metal layer 9 should be a thickness capable of performing metal-welding, and can be selected from 500 to 30000 Å. A method for forming the metal layer 9 can be selected from methods which do not affect the flatness, e.g., vacuum deposition, sputtering, chemical vapor deposition (CVD), and a screen printing method. After forming the metal layer 9, patterning can be performed if necessary.

According to a production method of an inkjet head described below, the protrusion 8 having the metal layer 9 has a sufficient flatness when the protrusion 8 is metal-bonded with another material, and do not require a bump having a high thickness like a general bump-bonding. Accordingly its production cost is low. A height of the protrusion 8 can be determined considering a production cost and, for example, selected from 5 to 500 μm.

The supply port 10 and the protrusion 8 are rectangle in FIG. 1, but the present invention is not limited to these shapes. For example, the supply port 10 and the protrusion 8 can have a tapered shape or a curved shape with respect to a plane of the silicon substrate 2.

Figure 2:
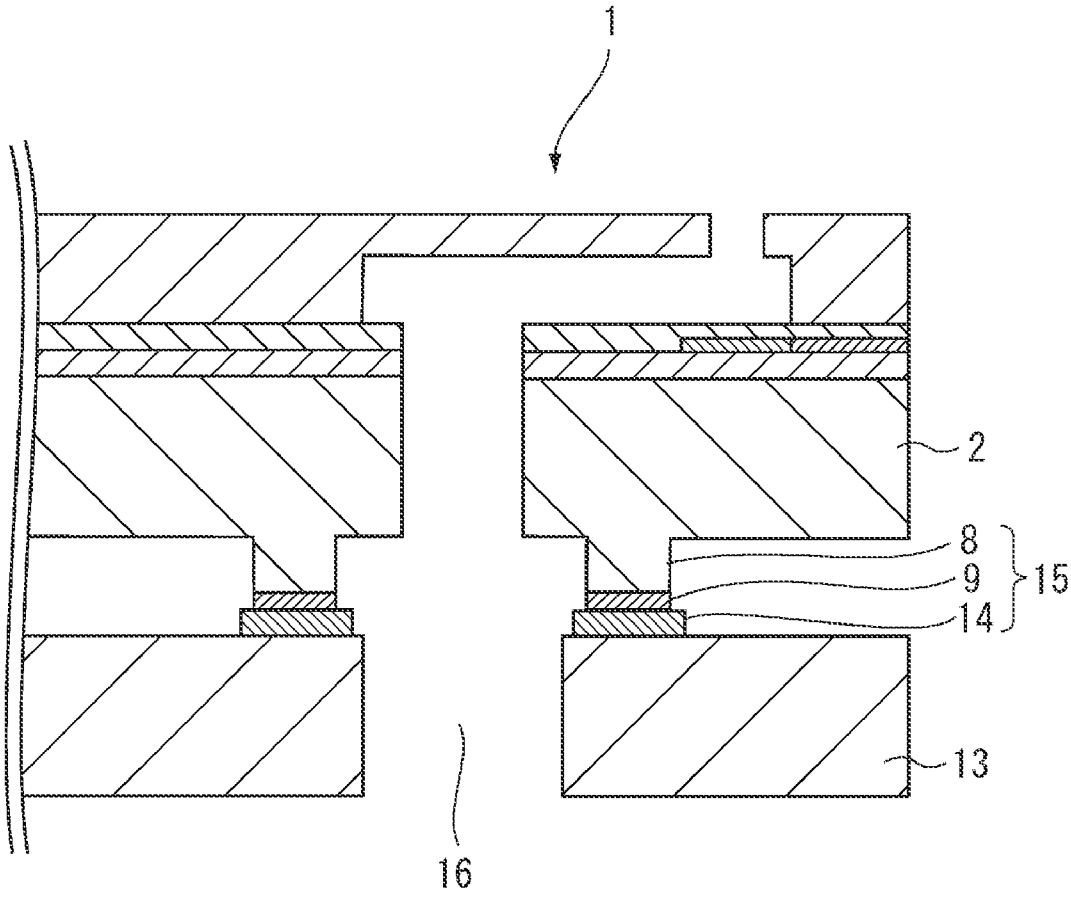
FIG. 2 illustrates a representative cross section of an inkjet head according to a first exemplary embodiment of the present invention.

FIG. 2 illustrates a configuration in which the protrusion 8 of the recording element substrate 1 contacts the supporting member 13, and is held and fixed. A material for the supporting member 13 can be selected from materials having high flatness and good processability, for example, a silicon single crystal substrate and a sintered body of an inorganic compound such as alumina can be selected. The silicon single crystal substrate can have an oxidized film on a surface to improve corrosion-resistance.

The supporting member 13 is coated with a second metal layer 14. The second metal layer 14 is metal-welded with the first metal layer 9 formed on the recording element substrate 1, so that the supporting member 13 and the recording element substrate 1 are bonded.

A material for the second metal layer 14 can be selected from inactive metals which are not eluted in ink or alloys including metals which are not eluted in ink, similar to the first metal layer 9. For example, gold or platinum can be used. A thickness of the metal layer 14 can be selected from 1000 to 50000 Å. Further, a method for forming the metal layer 14 can be selected from methods which do not affect flatness, e.g., vacuum deposition, sputtering, CVD, and a screen printing method can be selected. After forming the metal layer 14, patterning can be performed if necessary.

By performing metal-welding the first metal layer 9 and the second metal layer 14, a fluid partition wall 15 can be formed. The fluid partition wall 15 prevents ink, which passes through the supply port 10 and the through hole 16, from flowing out from a metal-bonded portion. As for a method for metal-bonding, for example, an ultrasonic welding can be used.

A sealing material for increasing adhesive property and sealing property can be filled in a part or a whole of a space other than an opening part in which ink flows-in. The space is formed between the recording element substrate 1 and the supporting member 13 by metal-welding. The sealing material can increase adhesive strength between the recording element substrate 1 and the supporting member 13. Further, even when ink flows-out from the bonding part of the metal layer 9 and the metal layer 14, the sealing material can prevent the ink from flowing into the supply port 10 and the through hole 16 in which another ink passes though. Therefore, sealing reliability of the fluid partition 15 can be improved by filling the sealing material.

As for a method for filling a sealing material, an under filling method is properly used. Since the fluid partition wall 15 is formed by metal-welding, controlling a dropping amount of the sealing material becomes easy. More particularly, even when the sealing material drops a lot, the fluid partition wall 15 prevents the sealing material from flowing into the through hole 16 and the supply port 10 in which ink passes through.

Now, a production method of the recording element substrate 1 according to the first exemplary embodiment of the present invention will be described with reference to FIGS. 4A to 4H. FIGS. 4A to 4H illustrate a cross section of the recording element substrate 1 in each step.

First, the silicon substrate 2 provided with the discharge pressure generating element 4, the drive circuit 5, the thermally-oxidized film 6, the passivation film 7, and the flow path forming member 3 are prepared. At this stage, the supply port 10 and the protrusion 8 which are illustrated in FIG. 1 are not formed in the silicon substrate 2.

Figure 4A:
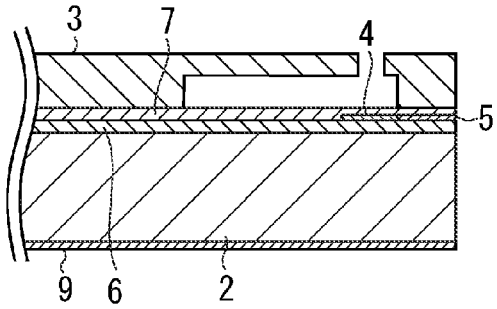
FIGS. 4A, 4B, 4C, 4D, 4E, 4F, 4G, and 4H are cross-sectional views illustrating production steps of an inkjet head according to a first exemplary embodiment of the present invention.

In step 1, as illustrated in FIG. 4A, the first metal layer 9 is formed on the second surface of the silicon substrate 2. The first metal layer 9 can be formed by a vacuum film formation technology, such as vacuum deposition, sputtering, or CVD.

Figure 4B:
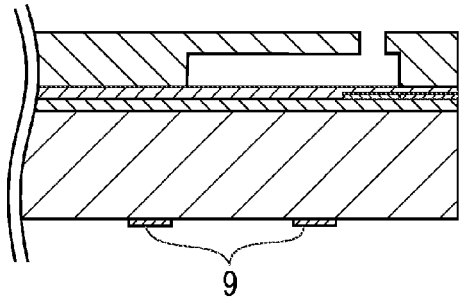

In step 2, as illustrated in FIG. 4B, patterning is performed on the first metal layer 9. As for the patterning method, masking using a photoresist, forming an opening at a position of the metal layer 9 to be removed, by exposing/developing, etching the opening by an etching method corresponding to the metal layer 9, and removing the photoresist are carried out. The etching method depends on the metal layer 9. For example, when the metal layer 9 is made of gold, wet etching is performed using a solution of iodine and a potassium iodide. Further, a desired pattern can be obtained with high accuracy by photolithography/etching of the metal layer 9.

Figure 4C:
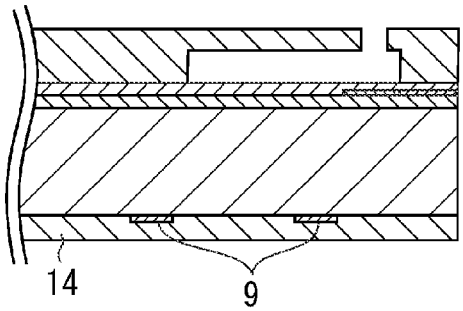

In step 3, as illustrated in FIG. 4C, a resist 14 is coated to form the supply port 10 on the second surface of the silicon substrate 2 provided with the metal layer 9. At this time, the metal layer 9 patterned in step 2 is embedded in the resist 14. The resist 14 is selected depending on etching/masking property for forming the supply port 10 and embeddable property of the metal layer 9. For the purpose of easy handling, a liquid photo-resist capable of spin-coating or a dry film resist previously formed in a sheet shape can be properly used.

Figure 4D:
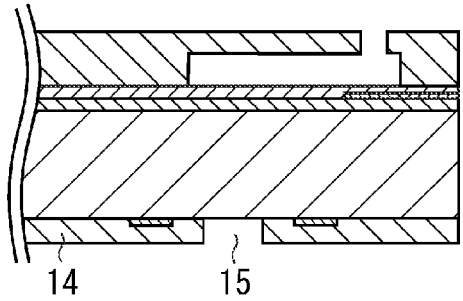

In step 4, as illustrated in FIG. 4D, an opening 15 is formed at a desired position where the supply port 10 of the resist 14 is formed in step 3, and the silicon substrate 2 is exposed. When a material having photosensitivity like the aforementioned photo-resist or the dry film resist is used as the resist 14, the opening part 15 can be formed by exposing/developing and positioned with high accuracy.

Figure 4E:
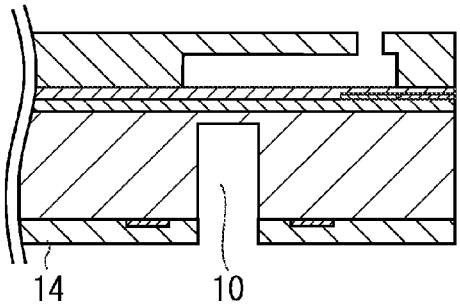

In step 5, as illustrated in FIG. 4E, the supply port 10 is formed from an exposure part of the silicon substrate 2, that is, the opening part 15 of the resist 14. A forming method can be selected depending on a shape of the supply port 10 to be formed. For example, reactive ion etching (RIE), chemical dry etching (CDE), crystal anisotropy etching, and other wet etchings can be used. As for the forming method of the supply port 10 in FIG. 4E, a dry etching method, so-called a Bosch process, in which the silicon substrate 2 is removed by repeating a deposition step and an etching step is used and the supply port 10 is vertically formed with respect to the silicon substrate 2.

Figure 4F:
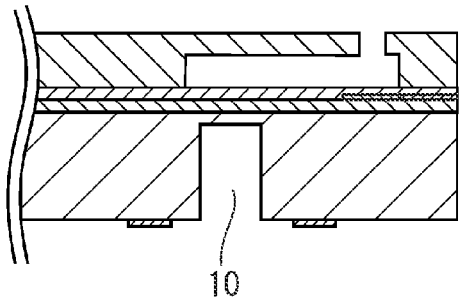

In step 6, as illustrated in FIG. 4F, the resist 14 is removed. As for a method for removing the resist 14, a separating liquid corresponding to the selected resist 14 is used. Further, the resist 14 can be removed by dry etching using a gas mainly including $O_2$.

Figure 4G:
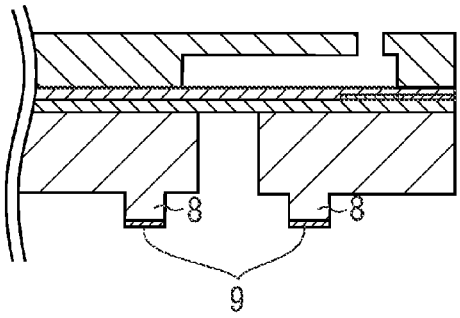

In step 7, as illustrated in FIG. 4G, entire surface etching is performed from the second surface of the silicon substrate 2 coated with the metal layer 9. In this etching, since the metal layer 9 acts as an etching mask, the portion of the silicon substrate 2 just under the metal layer 9 is not etched. Therefore, a portion of the silicon substrate 2 just under the metal layer 9 retains an original thickness, and the protrusion 8 illustrated in FIG. 4G is formed. The distal end of the protrusion 8 has very good flatness because the flatness of the silicon substrate 2 remains. The etching method depends on a desired shape. For example, RIE, CDE, crystal anisotropy etching, or other wet etchings can be used.

Since the entire surface etching is performed in step 7, an all silicon substrate 2 does not need to be removed when the supply port 10 is formed in step 5 as illustrated in FIG. 4E. More specifically, half-etching is performed in step 5, the remaining silicon substrate 2 is removed by entire surface etching in step 7, and the supply port 10 penetrating the silicon substrate 2 is formed. By taking these steps, over-etching of the supply port 10 can be suppressed.

Then, the thermally-oxidized film 6 and the passivation film 7 which are positioned at the supply port 10, are removed by RIE, so that the supply port 10 and the ink flow path 11 are connected.

Figure 4H:
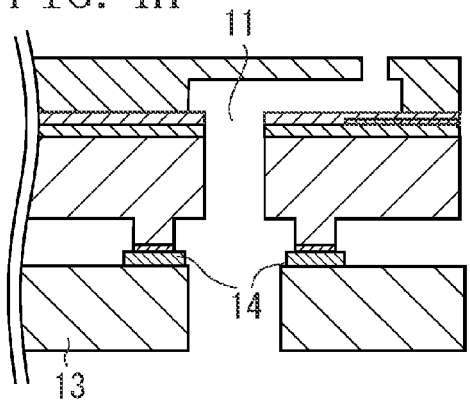

Finally, in step 8, as illustrated in FIG. 4H, metal-bonding of the first metal layer 9 remaining at the distal end of the protrusion 8 of the silicon substrate 2 and the second metal layer 14 provided on the supporting member 13 is carried out, and the silicon substrate 2 is held and fixed to the supporting member 13. As aforementioned, since the protrusion 8 having the first metal layer 9 has sufficient flatness for metal-bonding, the silicon substrate 2 and the supporting member 13 can easily bond each other in a large area even though there is not a structure for absorbing height difference such as the bump.

According to the inkjet head produced by the aforementioned steps of the exemplary embodiment of the present invention, the protrusion 8 can be formed while keeping the flatness with fine patterning. Sufficient sealing reliability is obtained by metal-welding even when a boding surface is miniaturized, and ink infiltration is reduced. Since the protrusion 8 can be formed with high positional accuracy, the protrusion 8 can be formed near the supply port 10, so that the recording element substrate 1 can be miniaturized.

Figure 3:
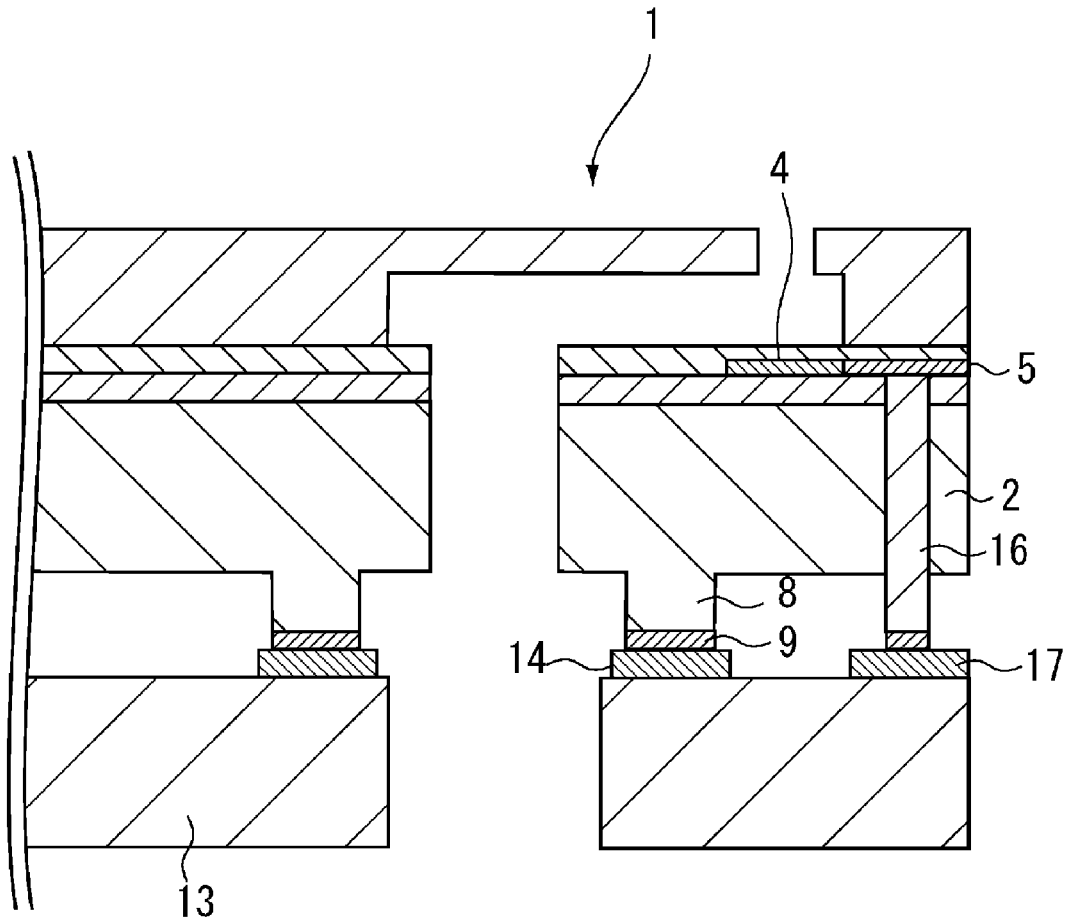
FIG. 3 illustrates a representative cross section of an inkjet head provided with a through electrode according to a second exemplary embodiment of the present invention.

FIG. 3 illustrates an inkjet head having a through electrode according to a second exemplary embodiment of the present invention. The recording element substrate 1 illustrated in FIG. 3 includes a through electrode 16 electrically connecting to the drive circuit 5 of the discharge pressure generating element 4 provided in the silicon substrate 2. The through electrode 16 penetrates the silicon substrate 2, and is exposed in a surface having the protrusion 8.

According to the configuration and production method of the second exemplary embodiment of the present invention, a connection of the trough electrode 16 to a wiring layer 17 provided on the supporting member 13 can be collectively performed together with the meta-bonding of the first metal layer 9 and the second metal layer 14. The wiring layer 17 formed in the supporting member 13 can be a metal generally used for wiring and, for example, aluminum or gold is preferable. At this time, if the same material as the second metal layer 14 is used for the wiring layer 17, the wiring layer 17 and the second metal layer 14 can be simultaneously formed.

The production method of the recording element substrate 1 provided with the through electrode 16 according to the second exemplary embodiment of the present invention will be described below with reference to FIGS. 5A to 5H. Detailed descriptions for a processing method will be omitted because the method is similar to the first exemplary embodiment.

The silicon substrate 2 is prepared which is provided with the discharge pressure generating element 4, the drive circuit 5, the thermally-oxidized film 6, the passivation film 7, and the flow path forming member 3, and includes the through electrode 16. The through electrode 16 electrically connects to the drive circuit 5 provided in the silicon substrate 2. At this stage, the supply port 10 and the protrusion 8 which are illustrated in FIG. 3 are not formed in the silicon substrate 2.

Figure 5A:
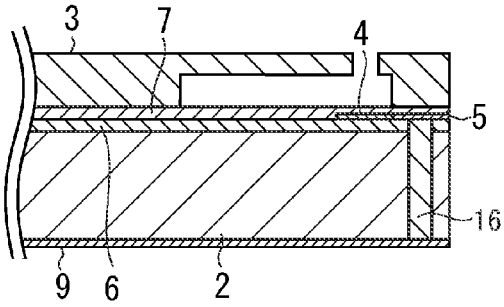
FIGS. 5A, 5B, 5C, 5D, 5E, 5F, 5G, and 5H are cross-sectional views illustrating production steps of an inkjet head having a through electrode according to a second exemplary embodiment of the present invention.
Figure 5B:
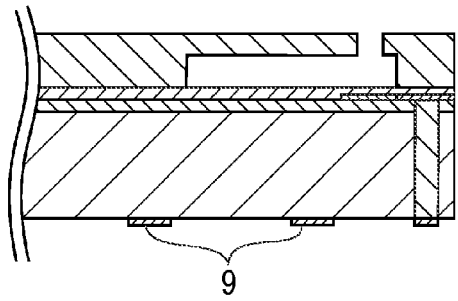

In step 1, as illustrated in FIG. 5A, the first metal layer 9 is formed on the second surface of the silicon substrate 2 opposing the first surface provided with the discharge pressure generating element 4. In step 2, as illustrated in FIG. 5B, patterning of the first metal layer 9 is performed. When the through electrode 16 is made of the same kind of metal as the metal layer 9 and the through electrode 16 is also removed by etching the metal layer 9, a portion where the through electrode 16 exists needs to be masked.

Figure 5C:
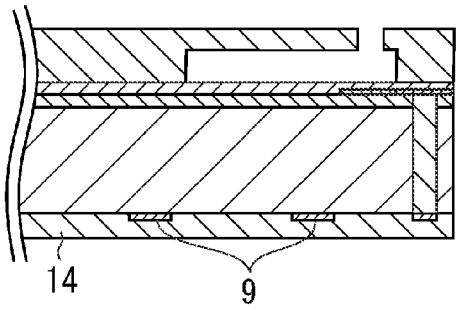
Figure 5D:
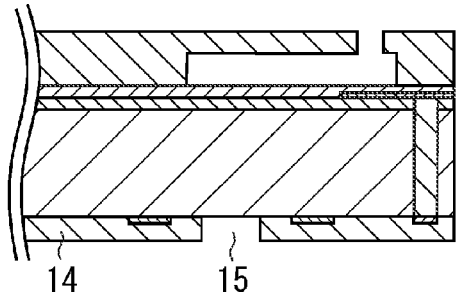
Figure 5E:
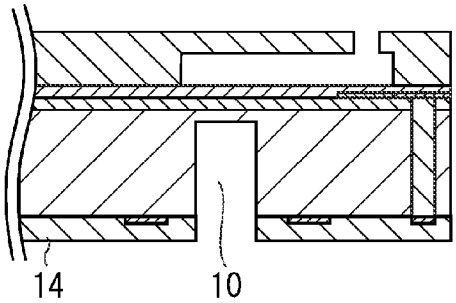
Figure 5F:
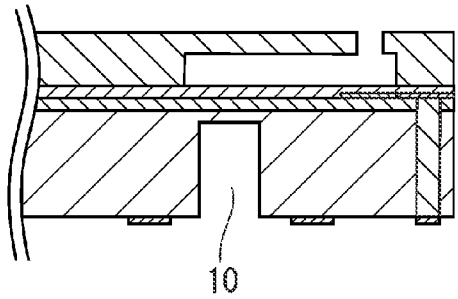

In step 3, as illustrated in FIG. 5C, the resist 14 for forming the supply port 10 is provided on the surface of the silicon substrate 2 coated with the metal layer 9. At this time, the metal layer 9 patterned in step 2 and the through electrode 16 are embedded under the resist 14. In step 4, as illustrated in FIG. 5D, the opening 15 of the resist 14 formed in step 3 is made at a desired position where the supply port 10 is formed. In step 5, as illustrated in FIG. 5E, the supply port 10 is formed from the opening 15 of the resist 14. In step 6, as illustrated in FIG. 5F, the resist 14 is removed.

Figure 5G:
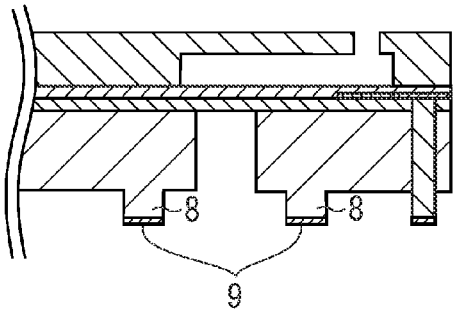

In step 7, as illustrated in FIG. 5G, entire surface etching is performed from the second surface of the silicon substrate 2 coated with the metal layer 9. At this time, since the metal layer 9 acts as an etching mask, the protrusion 8 illustrated in FIG. 5G is formed. Further, since the through electrode 16 is not etched but the silicon substrate 2 is etched back, the through electrode 16 has a shape projecting from the silicon substrate 2.

The etching method depends on a desired shape and an etching selection ratio of the metal layer 9 and the through electrode 16. For example, RIE, CDE, crystal anisotropy etching, and other wet etchings can be used. When the through electrode 16 is made of gold, for example, the aforementioned Bosch process can be used.

When the entire surface is etched using the metal layer 9 as an etching mask, the metal layer 9 and the through electrode 16 can maintain their original thickness, the protrusion 8 having the first metal layer 9 is formed, and the through electrode 16 projects from the silicon substrate 2. Therefore, the flatness of the protrusion 8 having the first metal layer 9, and the through electrode 16 becomes very good.

Since the entire surface etching is performed in step 7, all of the silicon substrate 2 do not need to be removed when the supply port 10 is formed in step 5. More specifically, half-etching can be performed in step 5, the remaining silicon substrate 2 is removed by the entire surface etching in step 7, and the supply port 10 is formed. By taking these steps, over-etching of the supply port 10 can be reduced.

Then, the thermally-oxidized film 6 and the passivation film 7 positioned at the supply port 10 are removed by RIE, and the supply port 10 is connected to the ink flow path 11.

Figure 5H:
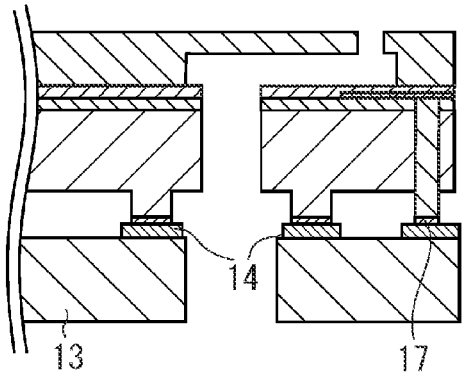

In step 8, as illustrated in FIG. 5H, the protrusion 8 having the first metal layer 9 and the through electrode 16 are formed by etching back the silicon substrate 2. Further, the metal layer 14 and the wiring layer 17, which are formed on the supporting member 13, are bonded. As aforementioned, since the protrusion 8 having the first metal layer 9 and the through electrode 16 have sufficient flatness for metal-bonding, the silicon substrate 2 and the supporting member 13 can be easily bonded in a large area even if there is not a structure for absorbing step-height such as a bump.

According to the inkjet head produced by the steps of the exemplary embodiment of the present invention, the protrusion 8 can be formed while maintaining the flatness with a fine pattern. Further, sufficient sealing reliability can be obtained by metal-welding even when a bonding surface is minute, and ink infiltration can be reduced. Since the protrusion 8 can be formed with high positional accuracy, the protrusion 8 can be formed near the supply port 10, and the recording element substrate 1 can be miniaturized. Simultaneously, an electrical connection of the through electrode 16 and the wiring layer 17 can be achieved.

A production method of the inkjet head according to the first exemplary embodiment of the present invention will be described in detail below by a first example using reference to FIGS. 6A to 6H.

A single crystal silicon wafer having a basic thickness of 300 μm and an ingot pulling-out orientation of <100> was prepared as the silicon substrate 2.

Figure 6A:
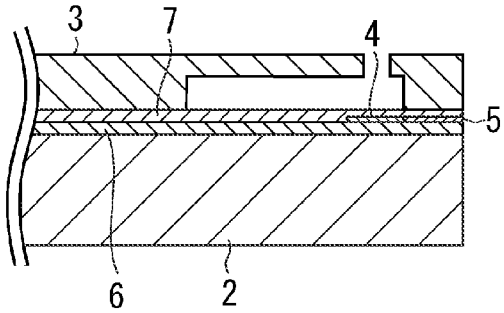
FIGS. 6A, 6B, 6C, 6D, 6E, 6F, 6G, and 6H are cross-sectional views illustrating production steps of an inkjet head according to a first example of the present invention.

As illustrated in FIG. 6A, the thermally-oxidized film 6 is formed on one surface of the silicon substrate 2, and, and the discharge pressure generating element 4 and the drive circuit 5 which drives the discharge pressure generating element 4, are arranged on the thermally-oxidized film 6. After forming the passivation film 7 for insulating ink from the discharge pressure generating element 4 and the drive circuit 5, the flow path forming member 3 having the discharge port 12 is provided on the passivation film 7.

Figure 6B:
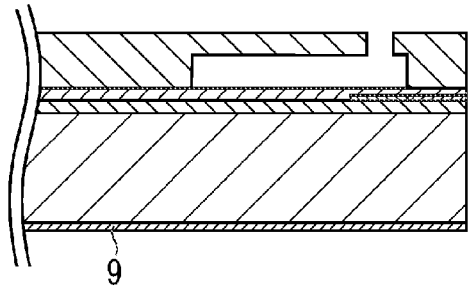
Figure 6C:
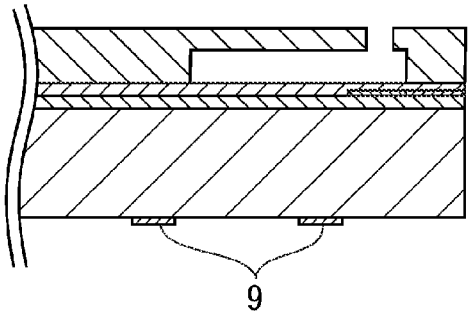
Figure 6D:
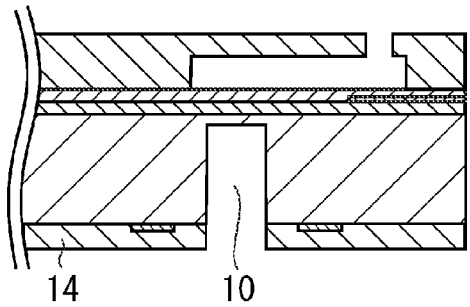

As illustrated in FIG. 6B, the metal layer 9 is formed on the second surface of the silicon substrate 2 opposing the first surface provided with the discharge pressure generating element 4. Gold is used as a material for the metal layer 9, and the metal layer 9 is formed by vacuum deposition to obtain a film in thickness of 2000 Å.

A positive type photoresist 14 is spin-coated on the metal layer 9, pattering is performed to have a desired pattern by exposing/developing, and the gold layer is wet-etched. For a gold etching liquid, a mixed solution of iodine and potassium iodide (AURUM-302, produced by KANTO CHEMICAL CO. INC.) was used. The processed silicon substrate 2 was dipped for 5 minutes in the gold etching liquid at 30° C., taken out from the gold etching liquid, well washed with water, dried, the photo resist 14 was exfoliated, and a configuration illustrated in FIG. 6C was obtained.

The positive type photo resist 14 was coated again on the surface of the silicon substrate 2 covered with the metal layer 9, and the patterned metal layer 9 was coated with the photo resist. The patterning was performed on the photo resist 14 and the photo resist in a portion for forming the supply port 10 was opened. The etching of the silicon substrate 2 was started from the opening, etching was performed by 270 μm in a thickness direction of the silicon substrate 2. Then, the etching was stopped, and a configuration illustrated in FIG. 6D was made. The silicon substrate 2 was dry-etched using an inductively coupled plasma (ICP) etching device (not illustrated). SF6 gas and C4F8 gas were used as etching gasses, and the Bosch process was implemented which alternatively performs an etching step and a deposition step.

Figure 6E:
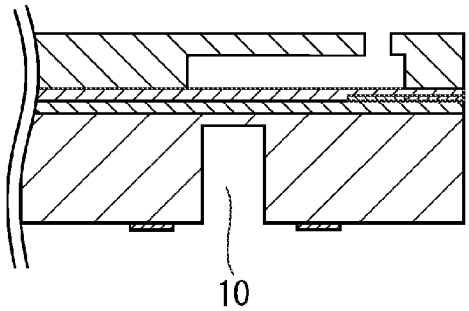

Then, the positive resist was exfoliated as illustrated in FIG. 6E.

Figure 6F:
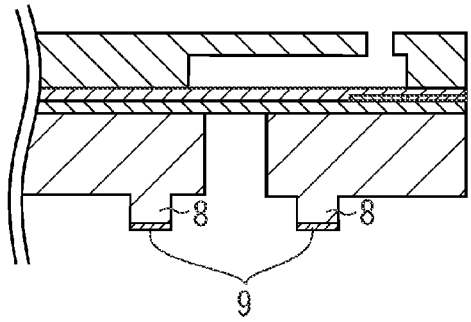

To remove the remaining silicon substrate 2 at the supply port 10, an entire surface of the silicon substrate 2 coated with the metal layer 9, was dry-etched by the Bosch process. As a result, as illustrated in FIG. 6F, etching did not proceed at the portion where the metal layer 9 which acts as a mask existed. As a result, the protrusion 8 was formed on the surface of the silicon substrate 2 coated with the metal layer 9. By this process, the protrusion 8 having the metal layer 9 which shows very good flatness was formed. The etching of the supply port 10 was stopped at the thermally-oxidized film 6 of the silicon substrate 2.

Figure 6G:
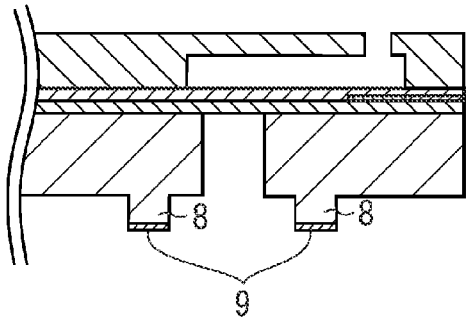
Figure 6H:
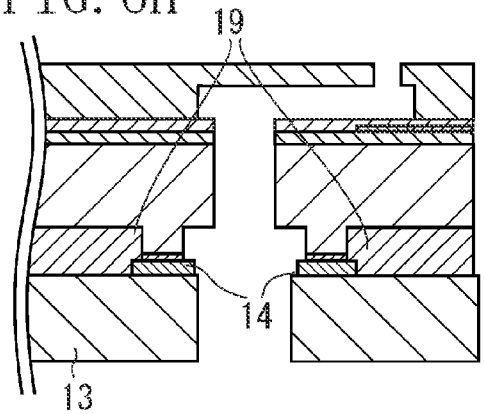
Figure 7:
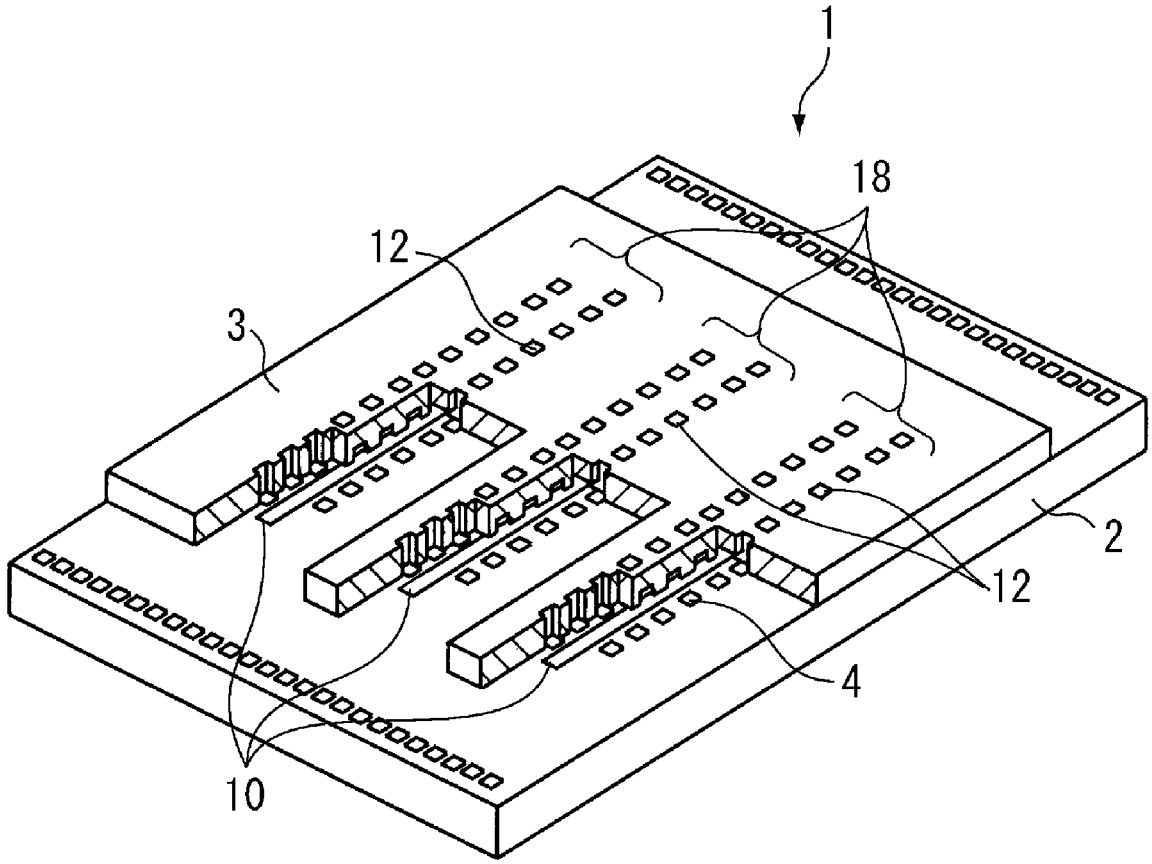
FIG. 7 is a perspective view illustrating a partially broken conventional recording element substrate for discharging multi-color inks.
Figure 8:
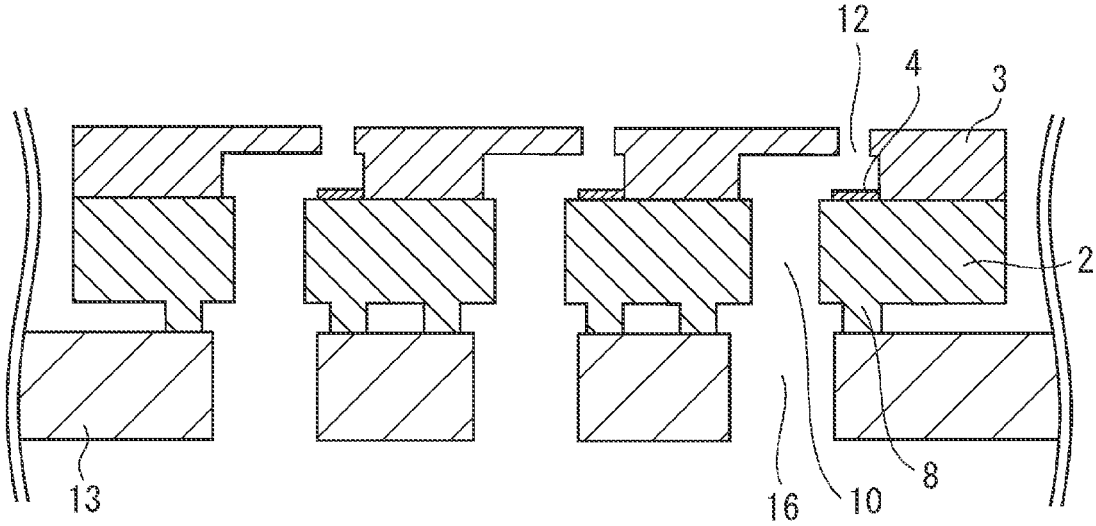
FIG. 8 is a cross-sectional view illustrating one example state in which a recording element substrate is fixed on a supporting member.

Then, as illustrated in FIG. 6G, the thermally-oxidized film 6 and the passivation film 7 were removed, which were positioned at the supply port 10, by RIE, and the supply port 10 and the ink flow path 11 were connected. Then, the wafer was diced to be a small piece.

On the other hand, the supporting member 13 made of alumina was prepared, a gold paste was printed on a desired portion to have a thickness of 1 μm by screen printing, and sintered, so that the metal layer 14 is formed. Then, the metal layer 14 of the supporting member 13 and the metal layer 9 of the silicon substrate 2 which was diced to be a small piece were metal-welded by ultrasonic welding.

Finally, the sealing material 19 was filled in a portion other than a fluid flow path in which a fluid (ink) flows, by an under filling method. Then, the sealing material 19 was baked, and the inkjet head having the fluid partition wall illustrated in FIG. 6H was completed.

The present invention can be applied to an inkjet head mounted in an inkjet recording apparatus which records an image by discharging inks having predetermined color phases as minute droplets, on a desired position of a recording paper.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-174178 filed Jul. 27, 2009, which is hereby incorporated by reference herein in its entirety.

What is claimed is:

1. An inkjet head comprising:
- a recording element substrate configured to discharge ink;
- a supply port configured to penetrate the recording element substrate and serve as an ink flow path;
- a protrusion provided at a position surrounding the supply port, projecting from one surface of the recording element substrate, and having a first metal layer; and
- a supporting member having a second metal layer welded with the first metal layer, and supporting the recording element substrate.

2. The inkjet head according to claim 1, wherein the first metal layer and the second metal layer include gold or platinum.

3. The inkjet head according to claim 1, wherein a sealing material is filled in an area between the recording element substrate and the supporting member, and other than an opening in which ink flows-in.

4. An inkjet head comprising:
- a recording element substrate comprising a discharge pressure generating element for discharging ink;
- a supply port configured to penetrate the recording element substrate and serve as an ink flow path;
- a protrusion projecting from a second surface of the recording element positioned opposite to a first surface having the discharge pressure generating element, and provided at a position surrounding the supply port;
- a supporting member contacting the protrusion and supporting the recording element substrate;
- a through electrode electrically connected with the discharge pressure generating element, and penetrating from the first surface to the second surface;
- first metal layers provided on a distal end of the protrusion and a distal end of the through electrode on the second surface side;
- a second metal layer provided on the supporting member and welded with the first metal layer on the distal end of the protrusion; and
- a wiring layer welded with the first metal layer of the through electrode.

5. The inkjet head according to claim 4, wherein the wiring layer is made of a same material as the second metal layer.

6. A production method of an inkjet head, the inkjet head comprising:
- a recording element substrate comprising a discharge pressure generating element for discharging ink;
- a supply port configured to penetrate the recording element substrate and serve as an ink flow path;
- a protrusion projecting from one surface of the recording element substrate, and arranged so as to surround the supply port;
- a supporting member contacting the protrusion and supporting the recording element substrate;
- a first metal layer provided on a distal end of the protrusion; and
- a second metal layer provided on the supporting member and welded with the first metal layer, the production method comprising:
- forming the first metal layer on one surface of the recording element substrate;
- forming a resist to cover the first metal layer such that a part of the one surface of the recording element substrate is exposed;
- forming the supply port by etching from an exposed part of the recording element substrate on which the resist is not formed;
- removing the resist;
- forming the protrusion by etching the recording element substrate using the first metal layer as an etching mask; and
- welding the first metal layer remaining on the distal end of the protrusion, and the second metal layer.

7. The production method of an inkjet head according to claim 6, further comprising:
- forming the first metal layer by retaining a necessary portion by patterning when the first metal layer is formed.

8. A production method of an inkjet head, the inkjet head comprising:

a recording element substrate comprising a discharge pressure generating element for discharging ink;

a supply port configured to penetrate the recording element substrate and serve as an ink flow path;

a protrusion projecting from a second surface of the recording element substrate positioned opposite to a first surface having the discharge pressure generating element, and arranged to surround the supply port;

a supporting member contacting the protrusion and supporting the recording element substrate;

a through electrode electrically connected with the discharge pressure generating element, and penetrating from the first surface to the second surface;

first metal layers provided on a distal end of the protrusion and one side of the through electrode not electrically connected with the discharge pressure generating element; and a second layer and a wiring layer provided on the supporting member and welded with the first metal layer, the production method comprising:

forming the first metal layer on a surface of the recording element substrate positioned opposite to the surface having the discharge pressure generating element, and exposing the through electrode;

forming a resist to cover the first metal layer and expose a part of a surface provided with the first metal layer;

forming the supply port by etching from the exposed part of the recording element substrate on which the resist is not formed;

removing the resist;

forming the protrusion by etching the recording element substrate using the first metal layer as an etching mask; and welding the first metal layers remaining on the distal end of the protrusion and on the through electrode, and the second metal layer and the wiring layer each other.

9. A recording element substrate comprising:

a silicon substrate comprising a discharge pressure generating element for discharging ink;

a supply port configured to penetrate the silicon substrate and supply ink to the discharge pressure generating element;

a protrusion formed at a position surrounding the supply port formed on a surface opposing a surface of the silicon substrate provided with the discharge pressure generating element; and a metal layer formed at a distal end of the protrusion.

* * * * *